US005393039A

United States Patent [19]

Smith

[11] Patent Number: 5,393,039

[45] Date of Patent: Feb. 28, 1995

[54] APPARATUS FOR CONVEYING, OPTIONALLY TREATING, AND DISPENSING ARTICLES

[75] Inventor: Frank B. Smith, Piedmont, Calif.

[73] Assignee: Dynarad Corporation, San Leandro, Calif.

[21] Appl. No.: 908,802

[22] Filed: Jul. 7, 1992

Related U.S. Application Data

[63] Continuation of Ser. No. 697,962, May 10, 1991, abandoned.

[51] Int. Cl.[6] ..... B22D 11/00

[52] U.S. Cl. ..... 266/261; 266/249; 432/141

[58] Field of Search ..... 266/249, 261, 901; 432/141, 142; 164/270

[56] References Cited

U.S. PATENT DOCUMENTS

| | | | |
|---|---|---|---|
| 2,093,376 | 9/1937 | Weaver et al. | 432/141 |
| 2,105,105 | 1/1938 | Zimmerman | 266/249 |
| 2,762,094 | 9/1956 | Vieth | 164/270 |
| 4,163,312 | 8/1979 | Green | 164/270 |

FOREIGN PATENT DOCUMENTS

| | | | |
|---|---|---|---|
| 0722550 | 11/1965 | Canada | 432/141 |

*Primary Examiner*—Scott Kastler
*Attorney, Agent, or Firm*—Paul M. Klein, Jr.

[57] ABSTRACT

Similar to a paddle wheel, a rotary magazine for storing and conveying articles is mounted to turn about a horizontal axis and has radially extending vanes spaced around and fixed to the periphery of a central cylinder. At an accessible region an article is loaded axially into the space between an adjacent pair of vanes. It is kept from falling out by support from a cylindrical surface separate from the magazine and spaced slightly beyond the outermost tips of the vanes. The surface partially encircles the magazine from its lowermost region up to the level where the article will not fall out. A single ejector ejects in the axial direction each article in turn as rotation of the magazine carries it from the loading region to an ejection location.

Optionally, an article can be treated, e.g. cooled, heated, irradiated, etc. in a treating chamber located on the path between loading region and ejection location. A sensor examining the treated article detects whether treatment was satisfactory or not and then either permits or prevents continued travel of the article to its final destination. A typical use is for conveying and pre-heating ingots destined to supply a melting furnace.

6 Claims, 5 Drawing Sheets

APPARATUS FOR CONVEYING, OPTIONALLY TREATING, AND DISPENSING ARTICLES

This is a continuation of Ser. No. 07/697,962, filed May 10, 1991, now abandoned.

BACKGROUND OF THE INVENTION

1. Field of the Invention

This invention relates to apparatus for conveying with facility a variety of types of articles in a magazine rotatable about a generally horizontal axis from a region where they are loaded into the magazine to a location where they are dispensed from the magazine. Optionally, while they are being conveyed from the loading region to the dispensing location they can be subjected to treatment such as cooling, heating, irradiation, spray coating etc.

2. Description of Related Art

U.S. Pat. No. 2,762,094 of A. B. Vieth shows an automatic casting machine having a polygonal cage rotatable about a horizontal axis and carrying a mold block attached to each side of the polygon. When a mold block is in a horizontal position at the top of the polygon molten metal is poured into the block to form a casting. Simultaneously another mold block with a solidified casting is horizontal at the bottom of the cage and the casting is ejected from it. The cage is adapted to convey only mold blocks and the castings in them. Unlike the present invention, the Vieth machine cannot convey a variety of types of articles. Also there is no suggestion in Vieth of subjecting the castings to treatment while they are being carried from the loading region to the ejection location.

U.S. Pat. No. 4,163,312 to Robert B. Green shows a machine with a conventional endless belt conveyor on which are mounted molds spaced along its length. At a first station molten metal is poured into the molds and the conveyor moves the molds to a second station where the ingots are ejected from the molds. The refractory linings of the molds are electrically heated to maintain the exterior side surfaces of the ingots in the molds at a desired temperature as the molds travel between the two stations. Because of the belt conveyor this machine occupies a large amount of floor space compared to the present invention. When articles conveyed by the present invention are optionally heated as they travel between loading and dispensing locations the invention avoids the need to supply and maintain separate heating elements for the containment structure for each article as Green must do.

SUMMARY OF THE INVENTION

The invention is an apparatus for conveying articles of a variety of types, shapes, and sizes from a loading region, where they are loaded into a magazine mounted to rotate about a generally horizontal axis relative to a base frame and enclosure, to an ejection location where they are dispensed from the magazine. The magazine is similar to a paddle wheel, having a cylinder with vanes fixed to and extending radially outward from the exterior of the cylinder and spaced from one another around the entire periphery of the cylinder. Each vane of a pair of adjacent vanes constitutes a boundary of the space between the pair of vanes to form, in part, a compartment to receive an article. A third boundary of the compartment is constituted by that part of the exterior surface of the cylinder to which the vanes are fixed that lies between the two vanes. Means separate from the magazine provides a surface at least partially surrounding the magazine, spaced outward from the radially outermost boundaries of the vanes so as not to interfere with rotation of the magazine, and forming a fourth boundary of those compartments that lie within the arc spanned by the surface. Each compartment is open at both ends so that an article can be moved into and out of the compartment in an axial direction. So as to prevent articles from possibly falling out of the magazine as it rotates, the surface forming the fourth boundary of the compartments is spaced so close to the periphery of the magazine that no article could fit between the surface and the outer tips of the vanes and the surface is made to extend around at least that entire region of the magazine from which articles in the compartments could likely fall out of the magazine. The surface can be constituted by, for example, the interior surface of a segment of a hollow cylinder that partially encircles the magazine. If, for example, it encircles the portion of the magazine from the 1:40 o'clock position of the hour hand of a clock clockwise around to the 10:20 o'clock position of hour hand, it accomplishes the desired result. Stated in other words, if the arcuate segment of the hollow cylinder subtends a reflex dihedral central angle of 250°, whose vertex lies on the axis of rotation of the magazine and each of whose two planes is inclined at an angle of 35° above the horizontal, it accomplishes the desired result.

The base frame and enclosure is configured to expose for loading a significant section of the front end of the magazine. Means is provided to rotate the magazine to carry each article from the loading region to an ejection location where it can be dispensed from the magazine by, e.g., moving it axially out of its compartment, either out the rear or out the front of the compartment, either by pushing it or by pulling it out with an extractor. It may then continue towards its ultimate destination by travelling along another pathway such as that provided by an inclined chute. To insure that an article reaches its final destination at an acceptably slow speed a stop means can be interposed in the path of the article as it traels down the chute. After the article is fully stopped the stop means is inactivated and the article is released to continue at a slower rate towards its destination.

Optionally, if it is desired to treat the article before it reach its final destination, as by cooling it, heating it, irradiating it, spray-coating some part of it, etc., this is accomplished by locating a treatment means in a region in the path leading from the loading region toward the ejection location. By locating the treatment region in that portion of the path of the compartments that lies beyond the span of the surface that forms the fourth boundary of the compartments then compartments in the treatment region will have only three bounding surfaces. This means that the radially outermost area of the articles in those compartments is effectively exposed to treatment without obstruction.

To insure that only articles that have been properly treated are allowed to reach the final destination a sensor is mounted to sense, at a location before the final destination, the state of the characteristic with which the treatment has endowed the article, e.g. its temperature, the adequacy of its sprayed coating, etc. By conventional control means the sensor can, if it senses an improper value of the state of the characteristic, activate means to prevent the article from reaching the final destination and sound an alarm.

DESCRIPTION OF A PREFERRED EMBODIMENT

Figure 1:
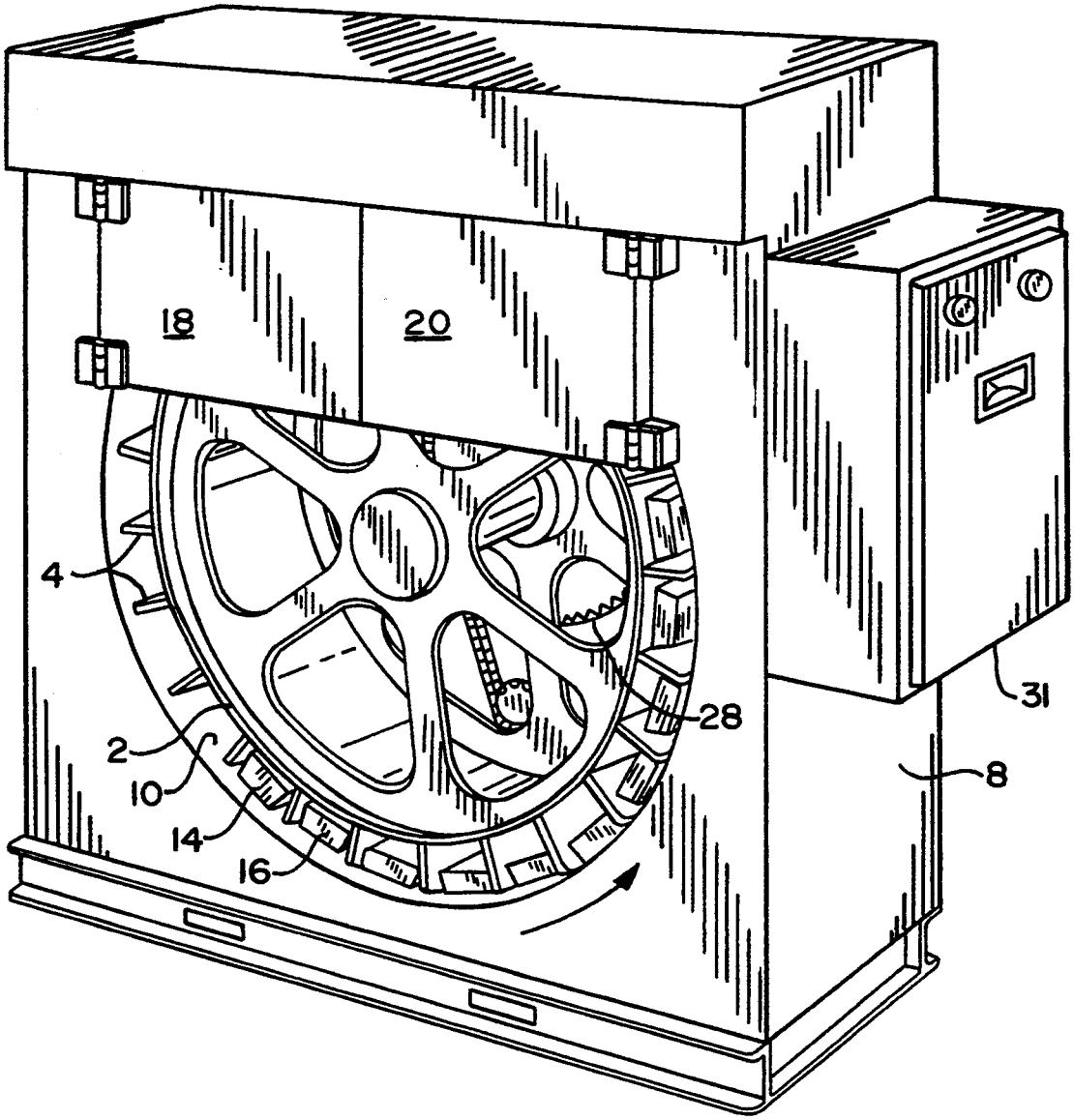
FIG. 1 is an axonometric view showing the front of a preferred embodiment of the invention adapted for handling ingots.
Figure 2:
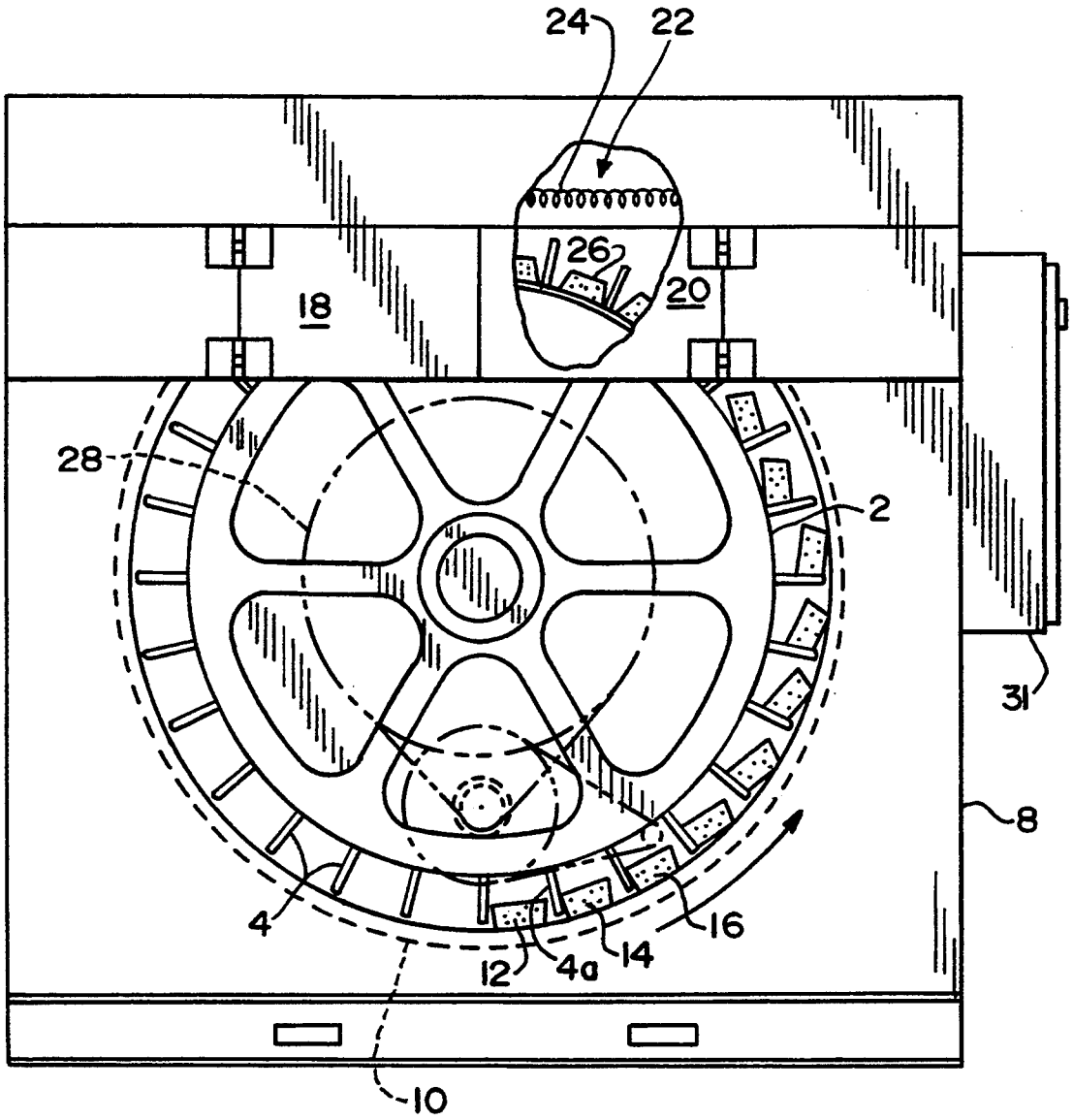
FIG. 2 is a front elevation view of the apparatus of FIG. 1.

A preferred embodiment shown in the drawings is an apparatus for handling ingots. It is specially useful for handling magnesium ingots which, to prevent an explosion, must be rendered free of moisture before they are allowed to enter a melting furnace containing molten metal. The embodiment comprises a rotary ingot storage magazine 2 similar to a paddle wheel and having vanes 4 extending from the outer rim of the magazine and spaced from each other around the periphery of the magazine. The magazine is supported to turn about a generally horizontal axis on a shaft 6 fixed in cantilever fashion to the rear of a base frame and enclosure 8. As seen in FIGS. 1 and 2, an opening in the front of structure 8 exposes the major portion of the magazine to access for manually loading ingots into compartments bounded on two sides by a pair of adjacent vanes. A metal shell 10, in the form of a segment of a hollow cylinder, is firmly fastened to the back panel and the front panel of structure 8 and partially encircles the magazine, being spaced a short distance from the radially outermost tips of the vanes so that there is no obstruction to rotation of the magazine and there is no possibility of an ingot slipping out between the magazine and the shell. As seen in FIG. 2, the shell 10 supports ingots, such as 12, 14, 16 while they are in the lowermost region of their rotary path. The material of the shell is abrasion-resistant to withstand sliding of the ingots.

The upper region of structure 8 forms an oven having access doors 18 and 20 for inspection and repair. The oven preheats the ingots as they travel in the slowly-turning magazine counterclockwise from the location behind door 20 to the region behind door 18. In FIG. 2 the oval 22 shows a cut through the door 20 and through the upper part of structure 8 to expose, for illustration, part of an electric heating element 24 and an ingot 26 in the oven region.

Figure 3:
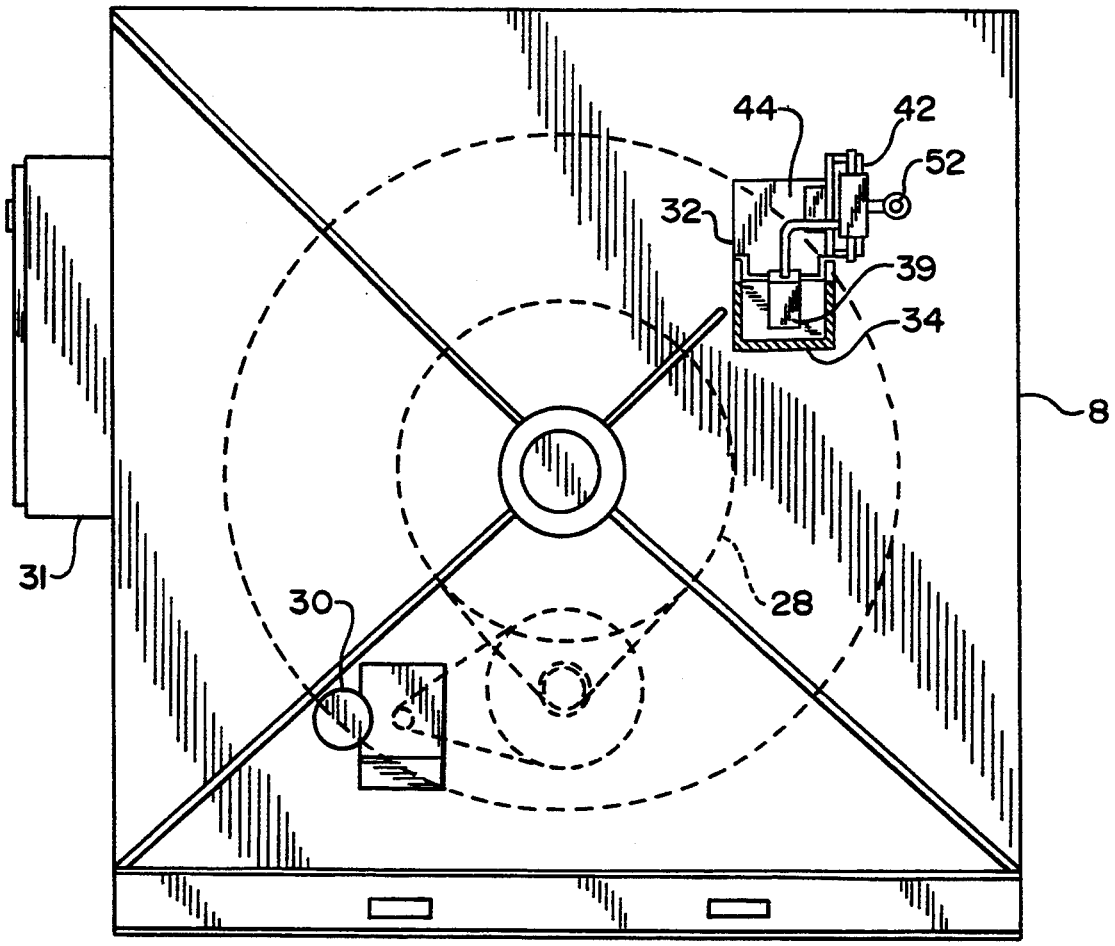
FIG. 3 is a back elevation view of the apparatus of FIG. 1; it is taken along the line 3—3 in FIG. 5.
Figure 5:
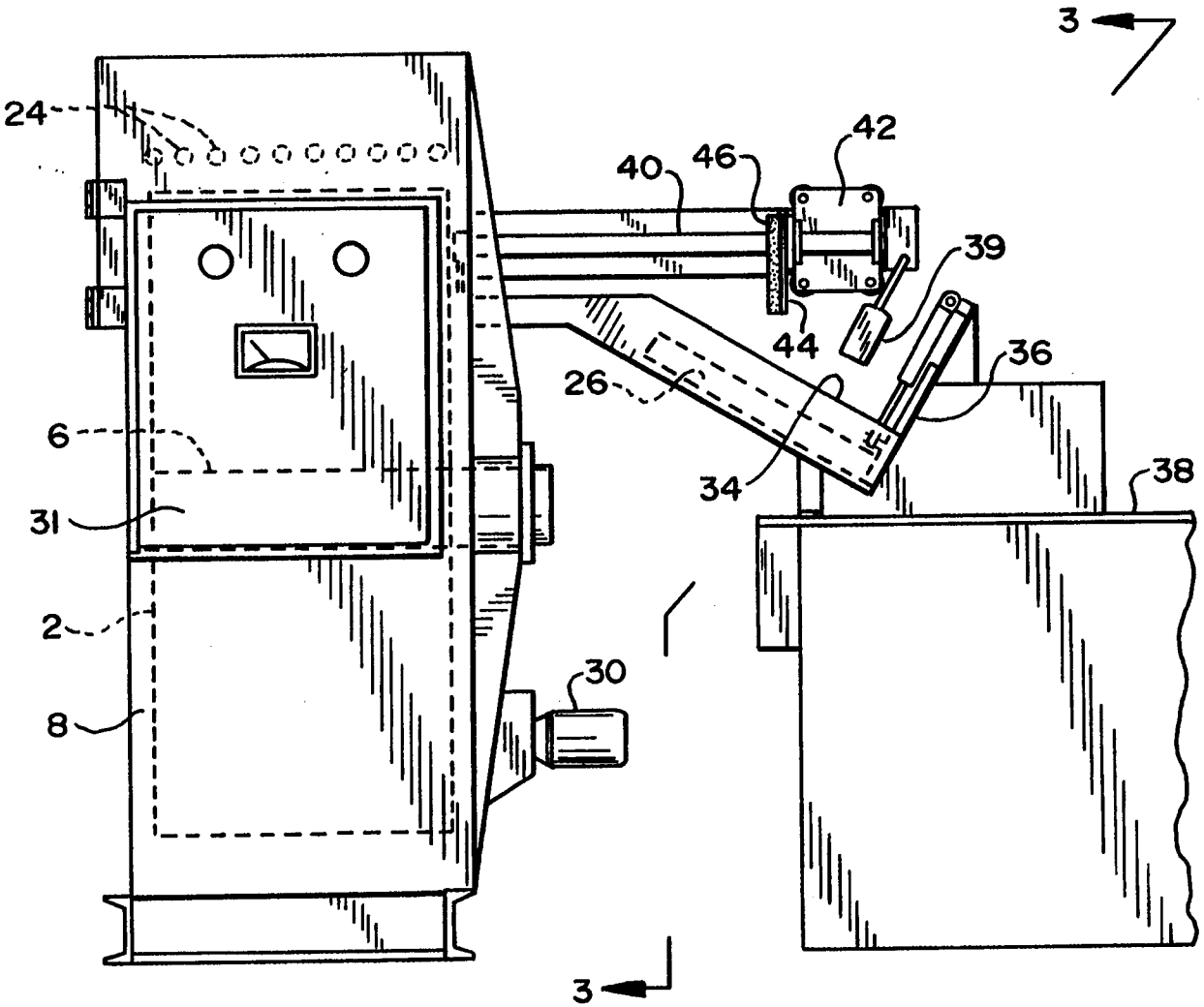
FIG. 5 is a side elevation view of the apparatus of FIG. 1.

A chain 28 drives a sprocket mounted to turn the magazine slowly enough that all moisture is evaporated from the ingots during the time when they travel in the oven region. The chain 28 is driven ultimately by motor 30, FIGS. 3 and 5, mounted on the back panel of structure 8. The motor speed is reduced through a standard reduction gear box adjacent the motor and thence further through various sprockets which can be selected to provide different desired rates of rotation of the magazine. The compartments of the magazine hold ingots of different sizes. If the magazine is loaded with smaller size ingots the demand of the melting furnace may be at a higher rate for delivering ingots to it than if the ingots are of larger size. The provision of various sprockets in the drive system makes it easy to change from one speed to another. Conventional control means for various functions are located in box 31.

Ingots are loaded manually into spaces between vanes simply by moving them axially from the front of the magazine toward the rear. The back panel of structure 8 limits distance the ingots can be inserted since an ingot pushed inward to the utmost will simply abut the back panel and harmlessly rub against it as the magazine turns. The compartment size is long enough for various ingot sizes so there is no need to push ingots against the back wall. An ingot 12 loaded at the 6 o'clock (i.e., at the bottom of a vertical diameter of the magazine) position of the hour hand of a clock in FIG. 2 rests on the shell 10 which supports all its weight. Ingots 14 and 16, for example, have their weights supported partly by shell 10 and partly by the vane, such as **4*a* for ingot 14, which pushes the ingots counterclockwise as the magazine rotates in the direction of the arrow in FIG. 2. When an ingot such as 14 reaches the 3 o'clock position (i.e., the right hand end of a horizontal diameter of the magazine as seen in FIG. 2) its weight is mostly supported by its pusher vane 4*a*. At the 12 o'clock position (i.e., at the top of a vertical diameter of the magazine) its weight is borne by the outer rim of the magazine to which the vanes are attached. The shell 10 encircles enough of the circumference of the magazine so as to prevent any ingot that could likely fall out of the magazine from doing so. As seen in FIG. 2** it extends from about the 10:20 o'clock position counterclockwise to about the 1:40 o'clock position. In other words, it subtends at the axis of rotation of the magazine a reflex dihedral central angle of 250°, each of whose two planes is inclined at an angle of 35° above the horizontal.

Figure 4A:
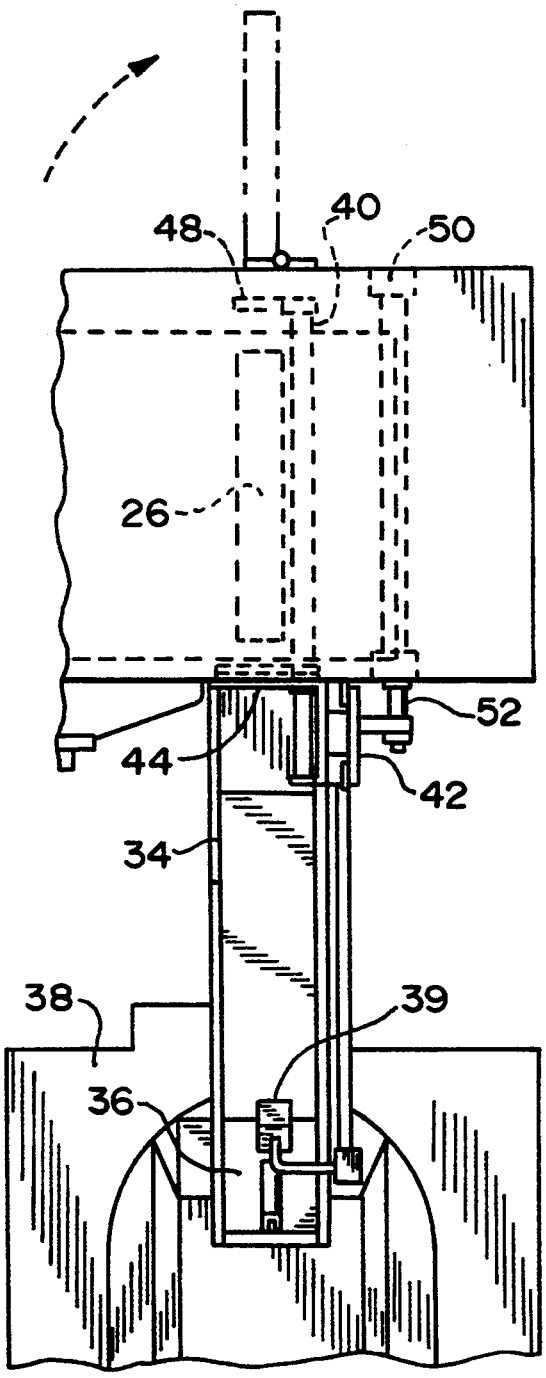
FIG. 4A is a fragmentary top view of the apparatus of FIG. 1 showing an extractor in readiness to eject an ingot.
Figure 4B:
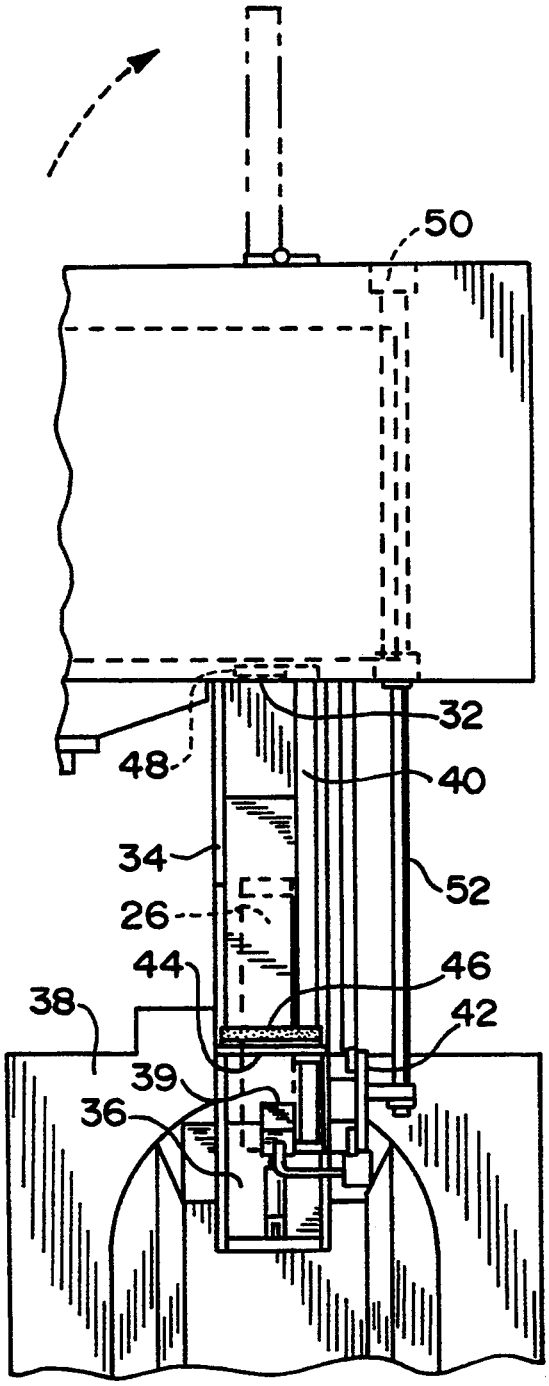
FIG. 4B is a fragmentary view similar to FIG. 4A with the extractor having ejected the ingot.

When an ingot arrives at about the 10:20 position (i.e., where it is intersected by a diametral plane inclined at an angle of 35° above the horizontal to the left as viewed in FIG. 2.) it is opposite an opening 32 in the rear panel of structure 8. In this position it can be dispensed from the magazine by being pulled by an extractor onto transfer chute 34 whence it slides to a stop against sliding guillotine-type door 36 which opens into a melting furnace 38, FIGS. 4 and 5. A control sensor 39 senses the temperature of the ingot while it is stopped at door 36 and allows the door to open only if the temperature is high enough to preclude the presence of moisture. The extractor 40 is similar in form to a hoe, such as a grub hoe, having a shaft with a blade extending transverse to it at one end. The shaft is fixed to move with a four-wheel carriage 42, FIGS. 4 & 5, riding on a track so as to guide the extractor along a straight line. Fixed to move with carriage is also a metal plate 44, provided with thermal insulation 46, to serve as a closure or door for closing opening 32 to prevent loss of heat from the oven region when the extractor is in its "home" position shown in FIG. 4A. In the "home" position the shaft of the extractor, which is made of metal, is in the oven and is therefore wrapped with thermal insulation to prevent it from drooping. Blade 48 of the extractor is shown in FIG. 4B in the position where it has just extracted an ingot 26 from the magazine to slide down the inclined chute 34. In FIG. 4A the extractor blade 48 is shown in position ready to eject ingot 26.

Reciprocal movements of carriage 42 and attached extractor are produced by pneumatic cylinder 50, FIG. 4, whose piston rod is connected 52 to the carriage 42.

Provided that the controls have received a signal that the melting furnace requires a supply of ingots, cylinder 50 is automatically actuated as each ingot reaches extraction position opposite opening 32. This pulls the extractor from its "home" position thus causing the blade 48 to pull an ingot out of the oven onto chute 34.

Many variations in the structure and operation of the apparatus are embraced by the concept of the invention. The egress opening for ejection of articles can be located elsewhere on the back of the structure than shown and can indeed be located on the front of the structure. The controls can be arranged so that the magazine stops rotating when an ingot is in position for ejection but if the furnace does not call for another ingot the magazine will stay in a stopped mode.

OPERATION

The preferred embodiment just described is an automatic ingot loader. To control its operation it uses a standard programmable controller which is housed, for example, in box 31, or mounted on a wall. At the start of an operating sequence electric power is switched on and sufficient time is allowed to preheat ingots, such as 26, that are in the oven section. The storage magazine 2 is fully loaded with ingots. Because a large segment of the magazine is accessible the loading can readily be accomplished by one worker standing in one position in front of the apparatus. Regular production operations are begun for which molten metal starts to be drawn from the furnace 38.

An external signal is received by the ingot loader to begin the operating cycle. The ingot extractor 40, 48 pulls out the hottest ingot in the last position in the ingot preheating section. This ingot slides down the transfer chute 34 to the entrance to the melting furnace 38 where it is blocked by the "guillotine" door 36. Stopping the ingot prevents excess splashing when the ingot enters the furnace. Also it enables the sensor 39 to detect whether the ingot is at the desired temperature while the ingot is stopped. If the sensor signals approval the door 36 opens and the ingot slides off the end of chute 34 into melting furnace 38. Door 36 then closes. The ingot extractor returns to its "home" or starting position shown in FIG. 4A.

The ingot magazine starts turning very slowly and stops when it has rotated exactly one ingot space, bringing a new, preheated ingot into the extraction position as well as a new, unheated ingot into the first preheating oven position. The cycle repeats when the next external signal is received.

Typically the ingot loader will automatically load ingots into a melting furnace at the rate of up to 24 ingots per hour. The rotation speed of the storage magazine can easily be increased to accommodate smaller ingots by exchanging drive sprockets.

Some advantages of this invention are to be noted. Magnesium ingots are commonly cast with teats that facilitate stacking for shipment. However these projections tend to catch on parts of prior art conveyors and jam the mechanism. The rotary conveyor of this invention provides what amounts to a simple box open at both ends as the compartment for an ingot. It has nothing for the teats of the ingot to catch on no matter whether the ingot is inserted in the compartment upside down or side ways. By providing the compartment with four sides to enclose the ingot during the largest part of its travel the chances of accidental displacement of the ingot to jam the machine are minimized. By terminating the fourth side, provided by cylindrical segment 10, as the ingot approaches the end of its travel in the magazine, unobstructed direct exposure of the ingot to the heaters in the oven is achieved and the provision of an extractor is facilitated. It is difficult to provide for extracting an ingot from a closed compartment having four sides. By simply omitting the heating elements the apparatus can serve simply to store and dispense ingots or other articles that require no heating. The configuration of the compartments of the magazine is such that articles of many different shapes and sizes can be handled with no likelihood of catching or jamming in the compartments. If the apparatus is to be used for such other diverse purposes as spray coating, cooling, irradiating, for example for sterilizing, with such diverse articles as packets of food or packets of medical supplies, then the appropriate equipment for the particular purpose can be installed in place of heating elements in the region of the apparatus that was an oven.

I claim:

1. An apparatus for conveying articles from a loading region where they are loaded onto a conveyor means to an ejection location and dispensing them at the ejection location comprising:

a base frame and housing structure, a magazine mounted to rotate about a generally horizontal axis, said magazine being generally in the form of a paddle wheel in that it has a cylinder with vanes fixed to and extending radially outward from the exterior of said cylinder and being spaced from one another around the periphery of the cylinder, each pair of adjacent vanes bounding the space between them to form, in part, a compartment to receive an article disposed loose in the compartment between, and not attached to, the two vanes of the pair, means separate from said magazine for providing a surface spaced outward from the radially outermost tips of the vanes and at least partially surrounding said magazine for furnishing support for articles in a certain segment of said magazine against which supporting surface said last-mentioned articles can bear and along and in contact with which said articles are caused to slide upon displacement of said vanes by rotation of said magazine, said certain segment of said magazine comprising those compartments bounded by a vane at the position on a horizontal diametral plane of the magazine to the right, as viewed from the loading region, of a vertical diametral plane and those compartments bounded by a vane at the position on that horizontal diametral plane to the left, as viewed from the loading region, of that vertical diametral plane and also comprising all those other compartments lying between said last-mentioned two vanes and lying below said horizontal diametral plane, said surface provided by said separate means serving as a barrier, to prevent articles in said magazine from falling out of said magazine, and extending around all of those compartments from which, absent such a barrier, articles in said last-mentioned compartments could likely fall out of said magazine because of the angles to a horizontal plane at which the vanes bounding said last-mentioned compartments are inclined, the arcuate span of said surface being exemplified by an arc which subtends at the axis of rotation of said magazine a reflex dihedral central angle of 250°, each of the two planes of which is inclined at an angle of 35° above the horizontal, means for rotating said magazine to move each compartment from a loading region where the compartment is accessible for the loading of an article into it to an ejection location at which the article can ejected from the compartment, and means for ejecting articles from the magazine at the ejection location.

2. The apparatus of claim 1 further including means providing a treatment region in which articles carried by said magazine can be treated, said treatment region being located so that, upon rotation of said magazine, each compartment passes into said treatment region on its path of travel from the loading region toward the ejection location, and means mounted in said treatment region for treating articles in said treatment region, said supporting surface being so terminated as to leave articles in said treatment region accessible for direct exposure, without obstruction, to said treatment means.

3. The apparatus of claim 2 wherein the means for treating articles in the treatment region is a unitary source of heat for all the articles exposed to it in the treatment region.

4. The apparatus of claim 2 further including means providing a path from the ejection location to a destination for an article ejected at the ejection location, means to sense the state of a characteristic of an article on said path, means for preventing an article from reaching the destination, and means controlled by said sensing means to inactivate said preventing means when said sensing means senses a desired state of the characteristic of the article.

5. An apparatus for conveying ingots from a loading region into a heating region and to an ejection location and dispensing them at the ejection location comprising:

a base frame and enclosure structure, a magazine mounted to rotate relative to said base frame and enclosure structure about a generally horizontal axis, said magazine being generally in the form of a paddle wheel in that it has a cylinder with vanes fixed to and extending radially outward from the exterior of said cylinder and being spaced from one another around the periphery of the cylinder, each vane of each pair of adjacent vanes forming a boundary surface of a compartment to receive an ingot, said magazine having a region the vanes in which are inclined at such angles to a horizontal plane that, absent an additional boundary surface, serving as a barrier, for compartments bounded by said last-mentioned vanes, ingots could likely fall out of said magazine from said last-mentioned compartments, means separate from said magazine for providing a surface spaced outward from the radially outermost tips of the vanes and extending around said entire region of said magazine to constitute an additional boundary surface for compartments in said region serving as a barrier to prevent ingots from falling out of said magazine from said last-mentioned compartments, said surface provided by said separate means also serving, for ingots in a certain segment of said region of said magazine, as a support against which said last-mentioned ingots bear and along and in contact with which said ingots are caused to slide upon displacement of said vanes by rotation of said magazine, said certain segment of said region of said magazine comprising those compartments bounded by a vane at the position on a horizontal diametral plane of the magazine to the right, as viewed from the loading region, of a vertical diametral plane and those compartments bounded by a vane at the position on that horizontal diametral plane to the left, as viewed from the loading region, of that vertical diametral plane and also comprising all those other compartments lying between said last-mentioned two vanes and also lying below said horizontal diametral plane, means for rotating said magazine to move each compartment from a loading region where the compartment is accessible for loading of an ingot into it to an ejection location at which the ingot can be ejected from the compartment, an oven chamber located so that, upon rotation of said magazine, each compartment passes into said chamber on its path of travel from the loading region toward the ejection location, means in said oven chamber for heating ingots carried into said chamber in said magazine, an egress opening in said oven chamber, means for ejecting ingots, one at a time from compartments of said magazine through said egress opening when each compartment is aligned with said egress opening, means providing a path for ingots leading from said egress opening toward a destination, means in said last-mentioned path to stop the motion of an ingot travelling along said path before it reaches the destination, and means operable, after the ingot has come to a stop and in response to predetermined conditions, for automatically inactivating said stop means, thus enabling said ingot to continue travel to its destination.

6. The apparatus of claim 5 wherein: said means providing a path for ingots from said egress opening is formed by a chute inclined downward from said egress opening and leading to a port for charging a melting furnace which is the destination for the ingot;

the means for stopping the ingot is a door at said port;

a sensor is provided to sense the temperature of an ingot stopped at the door; and control means is provided responding to both a predetermined elapsed time following ejection of an ingot and the sensing by the sensor of a predetermined temperature of the ingot for causing said door at said port to open to enable the ingot to enter the furnace.

* * * * *